US007963332B2

(12) United States Patent
Dotson et al.

(10) Patent No.: US 7,963,332 B2
(45) Date of Patent: Jun. 21, 2011

(54) APPARATUS AND METHOD FOR ABRASIVE JET PERFORATING

(76) Inventors: Thomas L. Dotson, Woodburn, KY (US); James F. Farr, The Woodlands, TX (US)

( * ) Notice: Subject to any disclaimer, the term of this patent is extended or adjusted under 35 U.S.C. 154(b) by 0 days.

(21) Appl. No.: 12/380,062

(22) Filed: Feb. 22, 2009

(65) Prior Publication Data

US 2010/0212903 A1 Aug. 26, 2010

(51) Int. Cl.
*E21B 43/11* (2006.01)

(52) U.S. Cl. ..... 166/298

(58) Field of Classification Search ..... 166/297, 166/298, 55, 55.7
See application file for complete search history.

(56) References Cited

U.S. PATENT DOCUMENTS

| | | | | |
|---|---|---|---|---|
| 3,130,786 | A | 4/1964 | Brown et al. | |
| 3,145,776 | A | 8/1964 | Pittman | |
| 3,266,571 | A | 8/1966 | St. John et al. | |
| 3,902,361 | A | 9/1975 | Watson | |
| 4,050,529 | A | 9/1977 | Tagirov et al. | |
| 5,499,678 | A | 3/1996 | Surjaatmadja et al. | |
| 5,765,642 | A | 6/1998 | Surjaatmadja | |
| 6,520,255 | B2 | 2/2003 | Tolman et al. | |
| 6,662,874 | B2 | 12/2003 | Surjaatmadja et al. | |
| 6,832,654 | B2 | 12/2004 | Ravensbergen et al. | |
| 7,159,660 | B2 | 1/2007 | Justus | |
| 7,631,698 | B2 * | 12/2009 | Miller et al. | 166/382 |
| 2006/0076137 | A1 * | 4/2006 | Malone et al. | 166/298 |

OTHER PUBLICATIONS

Cobbett, J.S., "Sand jet perforating revisited", Society of Petroleum Engineers Drilling and Completion, vol. 14, No. 1, pp. 28-33, Mar. 1999.

Li, Gensheng, et al., "Abrasive water jet perforation—An alternate approach to enhance oil production", Petroleum Science and Technology, vol. 22, Nos. 5&6, pp. 491-504, 2004.

McDaniel, B.W. et al., "Use of hydrajet perforating to improve fracturing success sees global expansion", SPE 114695, CIPC/SPE Gas Technology Symposium, Calgary, Canada, Jun. 2008.

* cited by examiner

*Primary Examiner* — William P Neuder
(74) *Attorney, Agent, or Firm* — Charles R. Schweppe

(57) ABSTRACT

A abrasive jet perforating tool comprises a generally cylindrically shaped tube with a side, an upper portion, and a lower portion; a plurality of holes tapped and threaded into the side of the tube; threaded abrasive jets mounted in at least some of the plurality of threaded holes; protective plates mounted on the side of the tube around the abrasive jets; gauge rings that slide onto an outer diameter of the upper portion and the lower portion of the tube; and a mechanical casing collar locator connected to the upper portion of the tube.

12 Claims, 6 Drawing Sheets

APPARATUS AND METHOD FOR ABRASIVE JET PERFORATING

CROSS-REFERENCES TO RELATED APPLICATIONS

Not Applicable

FEDERALLY SPONSORED RESEARCH OR DEVELOPMENT

Not Applicable

SEQUENCE LISTING, TABLE, OR COMPUTER LISTING

Not Applicable

BACKGROUND OF THE INVENTION

1. Field of the Invention

This invention relates generally to the field of treating wells to stimulate fluid production. More particularly, the invention relates to the field of abrasive jet perforating of wellbore casings.

2. Description of the Related Art

Abrasive jet perforating uses fluid slurry pumped under high pressure to perforate casing and cement around a wellbore and to extend a cavity into the surrounding reservoir to stimulate fluid production. Since sand is the most common abrasive used, this technique is also known as sand jet perforating (SJP). Sand laden fluids were first used to cut well casing in 1939. Abrasive jet perforating was eventually attempted on a commercial scale in the 1960s. While abrasive jet perforating was a technical success (over 5,000 wells were treated), it was not an economic success. The tool life in abrasive jet perforating was measured in only minutes and fluid pressures high enough to cut casing were difficult to maintain with pumps available at the time. A competing technology, explosive shape charge perforators, emerged at this time and offered less expensive perforating options.

Consequently, very little work was performed with abrasive jet perforating technology until the late 1990's. Then, more abrasive-resistant materials used in the construction of the perforating tools and jet orifices provided longer tool life, measured in hours or days instead of minutes. Also, advancements in pump materials and technology enabled pumps to handle the abrasive fluids under high pressures for longer periods of time. The combination of these advances made the abrasive jet perforating process more cost effective. Additionally, the recent use of coiled tubing to convey the abrasive jet perforating tool down a wellbore has led to reduced run time at greater depth. Further, abrasive jet perforating did not require explosives and thus avoids the accompanying danger involved in the storage, transport, and use of explosives. However, the basic design of abrasive jet perforating tools used today has not changed significantly from those used in the 1960's.

Abrasive jet perforating tools were initially designed and built in the 1960's. There were many variables involved in the design of these tools. Some tool designs varied the number of jet locations on the tool body, from as few as two jets to as many as 12 jets. The tool designs also varied the placement of those jets, such, for example, positioning two opposing jets spaced 180° apart on the same horizontal plane, three jets spaced 120° apart on the same horizontal plane, or three jets offset vertically by 30°. Other tool designs manipulated the jet by orienting it at an angle other than perpendicular to the casing or by allowing the jet to move toward the casing when fluid pressure was applied to the tool.

Occasionally, a tool employed a centralizer to keep the tool from touching the low side of the casing. Conventional tools typically have a uniform outer diameter, with the exception of the mounting locations for the jets. Mechanical casing collar locators generally consisted of a tool with a hollow shaft for fluid travel, and a "slip" (or "dog") that resides in a pocket on the outside of the tool and is pressed against the casing by a spring located in between the pocket and the slip.

The following patents are representative of conventional abrasive jet perforating tools, along with apparatus and methods that may be employed with the tools.

U.S. Pat. No. 3,130,786 by Brown et al., "Perforating Apparatus", discloses an abrasive jet perforating tool. The tool comprises a cylindrical conduit for abrasive fluid to be pumped through and jet nozzles laterally extending from the conduit to direct the abrasive fluid through the casing into the surrounding formation. Factors such as the pressure differential and the ratios of the diameter of the nozzle orifice to the length of the nozzles and to the size of the abrasives are kept within predetermined limits for optimum penetration.

U.S. Pat. No. 3,145,776 by Pittman, "Hydra-Jet Tool", discloses protective plates for an abrasive jet perforating tool. The plates, made of abrasive resistant material, are designed to fit flatly to the body of the tool around the perforating jets. The plates are employed to protect the body of the tool from ejected abrasive material that rebounds. The protective plates disclosed in Pittman are not designed to protect the abrasive jets themselves.

U.S. Pat. No. 3,266,571 by St. John et al., "Casing Slotting" discloses an abrasive jet perforating tool designed to cut slots of controlled length. The slot lengths are controlled by abrasive resistant shields attached to the tool to block the flow from rotating abrasive jets.

U.S. Pat. No. 3,902,361 by Watson, "Collar Locator" discloses a mechanical casing collar locator that can be used with, among other tools, an abrasive jet perforating tool. A spring-loaded tagging element engages the annular shoulder formed between the spaced ends of adjacent casing joints joined together by the collars. A tubing weight indicator senses each time a collar is located.

U.S. Pat. No. 4,050,539 by Tagirov et al., "Apparatus for Treating Rock Surrounding a Wellbore", discloses an abrasive jet tool for successively perforating and then fracturing reservoirs. The nozzles of the abrasive jets are designed to snugly fit against the casing to allow perforating at one pressure immediately followed by fracturing at a higher pressure.

U.S. Pat. No. 5,499,678 by Surjaatmadja et al., "Coplanar Angular Jetting Head for Well Perforating", discloses a jetting head for use in an abrasive jet perforating tool. The jet openings in the jetting head are coplanar and positioned at an angle to the longitudinal axis of the tool. The angle is chosen so that the plane of the jet openings is perpendicular to the axis of least principal stress in the formation being fractured. The tool must be custom-made for each job, since the entire jet head is angled into the tool.

U.S. Pat. No. 6,832,654 B2 by Ravensbergen et al., "Bottom Hole Assembly", discloses a bottom hole assembly (BHA) in the form of a straddle packer for positioning an abrasive jet perforating tool. The BHA includes a timing mechanism to keep dump ports open to flush underdisplaced fluids from the BHA, a release tool in case the BHA gets stuck in the wellbore, and a mechanical collar locator.

U.S. Pat. No. 7,159,660 B2 by Justus, "Hydrajet Perforating and Fracturing Tool" discloses an abrasive jet perforating and fracturing tool. The tool comprises both abrasive jet ports and fracturing ports having larger apertures than the jet ports. The fracturing ports are used to eject fracturing fluid into the formation at a faster rate than possible through the jet ports. The tool further comprises a rotating sleeve, turned by a power unit, with apertures that align or misalign with the jet ports and control ports to control flow through the ports.

A common concern for downhole tools in general, and abrasive jet perforating tools in particular, is the potential for getting the tool lodged or caught in the hole. As the abrasive jet perforating process begins, sand laden fluid is pumped through the tool at high pressure to cut through the casing and extend a cavity into the reservoir. As the fluid jet is cutting through the steel casing, all of the sand that passes through the orifice remains in the annulus of the casing. While some of this sand falls toward the bottom of the hole, some of the sand is pushed upward by the turbulent fluid action of the jet. If the fluid conditions (depending upon the viscosity of the fluid and the rate of fluid flow) are favorable, then the sand could return to the surface in the fluid flow, or, alternatively, the sand could travel a distance upward, lose velocity, and then fall back toward the bottom of the hole, settling wherever it can. Once the abrasive jet perforating tool has cut a hole in the casing, the sand particles enter the cavity that is being cut, but since the cavity is closed, most of the sand will return to the casing. The cuttings from the reservoir will also flow to the casing as the cavity is cut, creating more material in the annulus of the well. If the volume of the sand and formation cuttings deposited on the tool is too great, the tool could become trapped in the well by the material settling on the bottom hole assembly.

An additional concern in openhole conditions (a well without a casing) is that large pieces of the formation might fall into the well bore as the abrasive jet cuts its path. With a cased reservoir, the perforation hole in the casing limits the particle size of the cutting that can be flushed back into the annulus. In openhole wells, the particle size is not limited and, depending on the strength of the reservoir, large pieces of rock could break loose and fall into the wellbore, lodging in between the tool string and the wall of the well.

Thus, a need exists for a sand jet perforating tool and method of use that provides improvements to the sand jet perforating tool design that allow for improved performance, more cost effective operation, and increased security of the intellectual property.

BRIEF SUMMARY OF THE INVENTION

The invention is an apparatus and a method for providing improved abrasive jet perforating in wells. In one embodiment, the invention is an abrasive jet perforating tool comprising a generally cylindrically shaped tube with a side, an upper portion, and a lower portion; a plurality of holes tapped and threaded into the side of the tube; threaded abrasive jets mounted in at least some of the plurality of threaded holes; protective plates mounted on the side of the tube around the abrasive jets; gauge rings that slide onto an outer diameter of the upper portion and the lower portion of the tube; and a mechanical casing collar locator connected to the upper portion of the tube.

In another embodiment, the invention is a method for performing abrasive jet perforating, comprising determining well parameters for a well; assembling an abrasive jet perforating tool according to the well parameters, wherein the abrasive jet perforating tool is the apparatus described above; and perforating the well with the assembled abrasive jet perforating tool.

BRIEF DESCRIPTION OF THE DRAWINGS

The invention and its advantages may be more easily understood by reference to the following detailed description and the attached drawings, in which.

While the invention will be described in connection with its preferred embodiments, it will be understood that the invention is not limited to these. On the contrary, the invention is intended to cover all alternatives, modifications, and equivalents that may be included within the scope of the invention, as defined by the appended claims.

DETAILED DESCRIPTION OF THE INVENTION

The invention is an apparatus and a method for providing improved abrasive jet perforating in wells. The invention includes improvements to existing designs that enhance performance of the tool, make it more cost effective to build and operate, and help protect it from unwanted duplication. Improvements include outer diameter designs to keep formation cuttings from causing the tool to become lodged in the hole, additional vertical jet locations to prevent sand and cuttings from depositing on the upper portions of the tool and improve circulation of cuttings to the surface. A mechanical casing collar locator is also incorporated into the tool allowing for precise depth measurement. Variable abrasive jet sizes and lengths, variations in protective plates around the abrasive jets, along with gauge rings allow one basic tool to be used in different casing sizes, and special jet head and protective plate configurations make the abrasive jets difficult to remove without the proper tools.

In one embodiment, the invention is an apparatus for performing abrasive jet perforating. That is, the invention is an abrasive jet perforating tool. In another embodiment, the invention is a method for performing abrasive jet perforating. That is, the invention includes a method for using the abrasive jet perforating tool of the invention.

Figure 1:
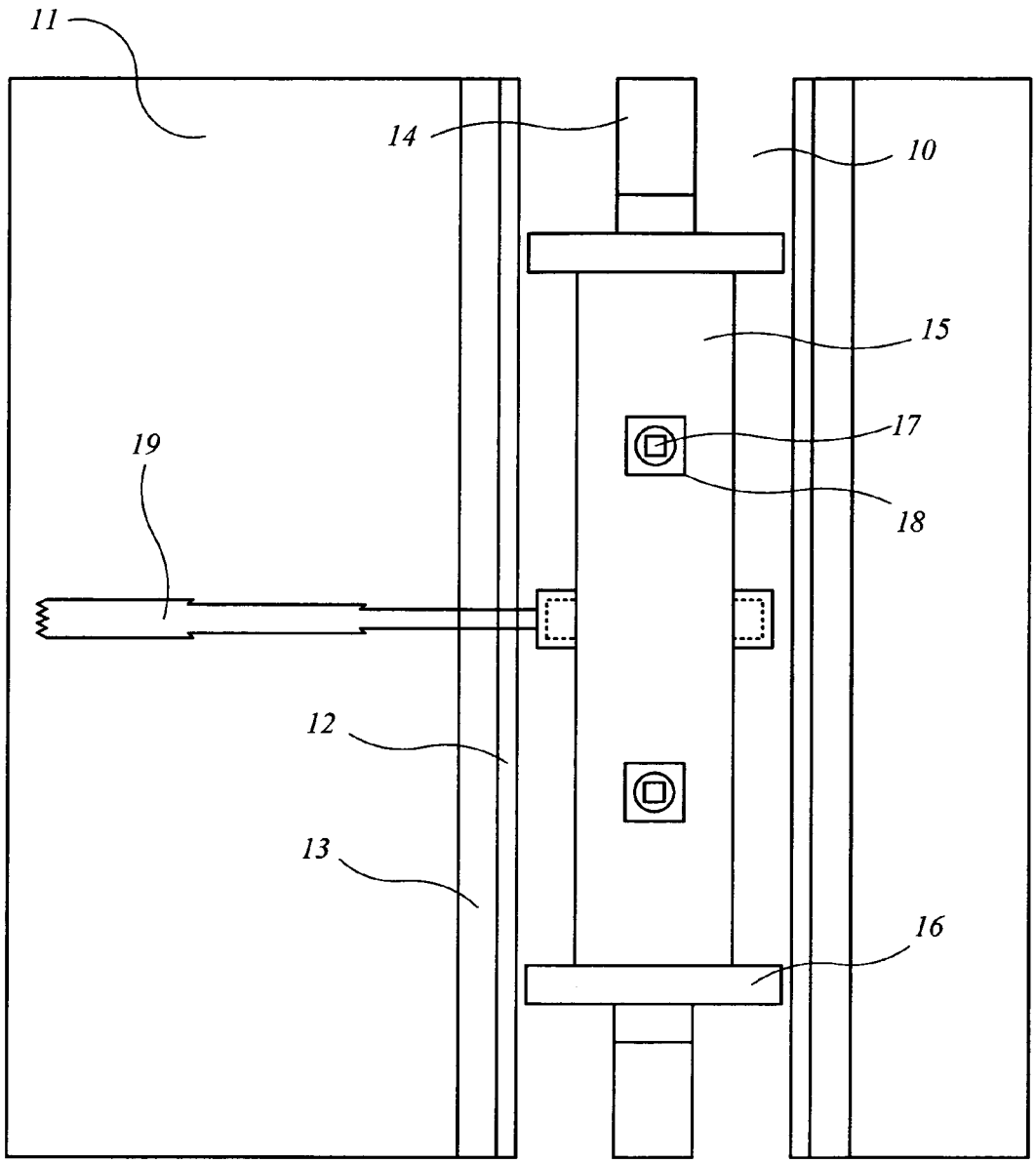
FIG. 1 is a schematic side view of an abrasive jet perforating tool in a wellbore.

FIG. 1 shows a schematic side view of an abrasive jet perforating tool, such as may be used in the present invention, in a wellbore. A wellbore 10 is shown penetrating a reservoir 11. The wellbore 10 is surrounded by a casing 12, which in turn is surrounded by cement 13, fixing the casing 12 to the reservoir 11. Well tubing 14 extends vertically downward into the wellbore 10. Suspended from the tubing 14 is an abrasive jet perforating tool 15, which comprises gauge rings 16 to center the tool 15 in the wellbore 10, abrasive jets 17, and protective plates 18. The abrasive jets 17 eject abrasive-carrying fluid slurry under high pressure to perforate the casing 12, cement 13, and reservoir 11. The protective plates 18 protect the abrasive jets 17 from damage due to the rebound of abrasive material in the ejected fluid slurry. The purpose of the abrasive jets 17 is to provide a cavity 19 in the reservoir 11 that communicates through the cement 13 and casing 12 with the wellbore 10. This cavity 19 provides improved fluid flow from the reservoir 11 to the wellbore 10, preferably from a producing zone in the reservoir 11. In an alternative situation called an openhole wellbore, there is no casing 12 or cement 13, so the wellbore 10 directly contacts the reservoir 11.

Figure 2:
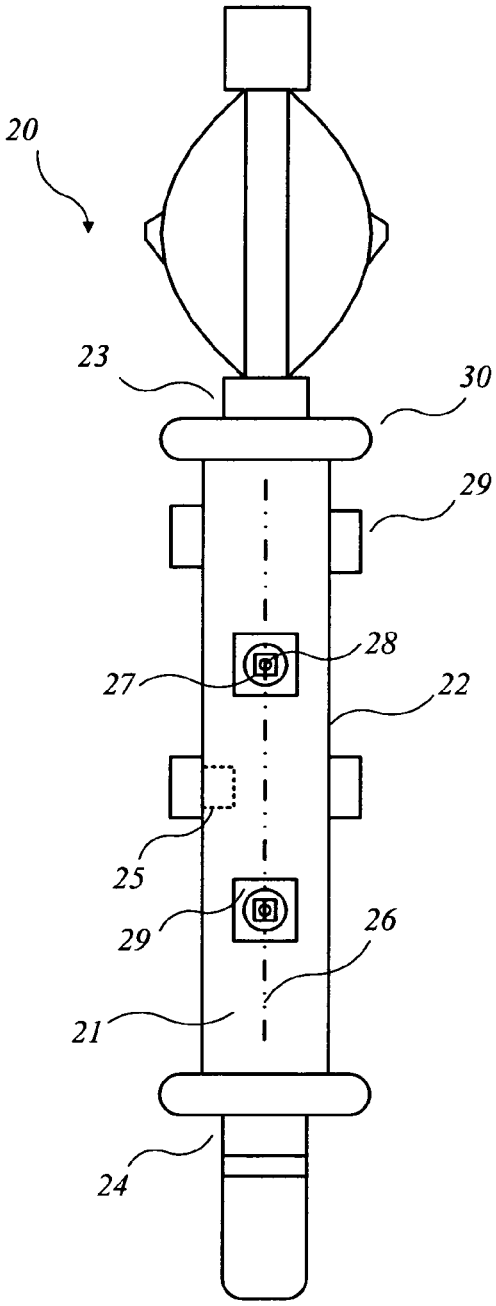
FIG. 2 is a schematic side view of a general embodiment of the tool of the invention.
Figure 3:
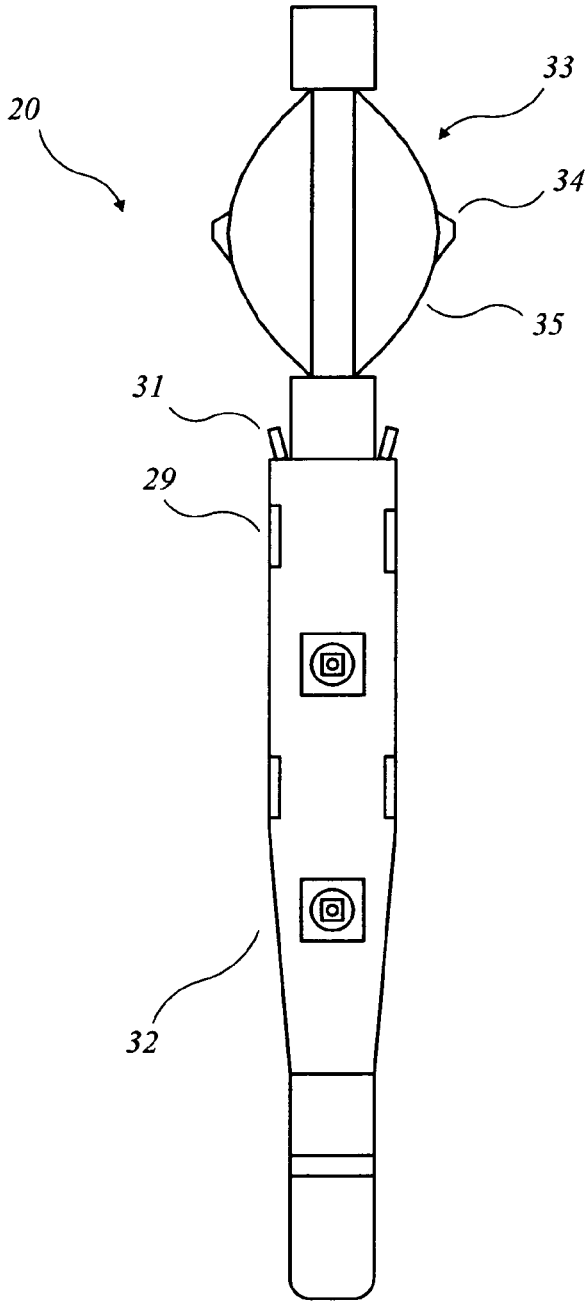
FIG. 3 shows a schematic side view of an alternative embodiment of the tool of the invention with a tapered lower portion.
Figure 4:
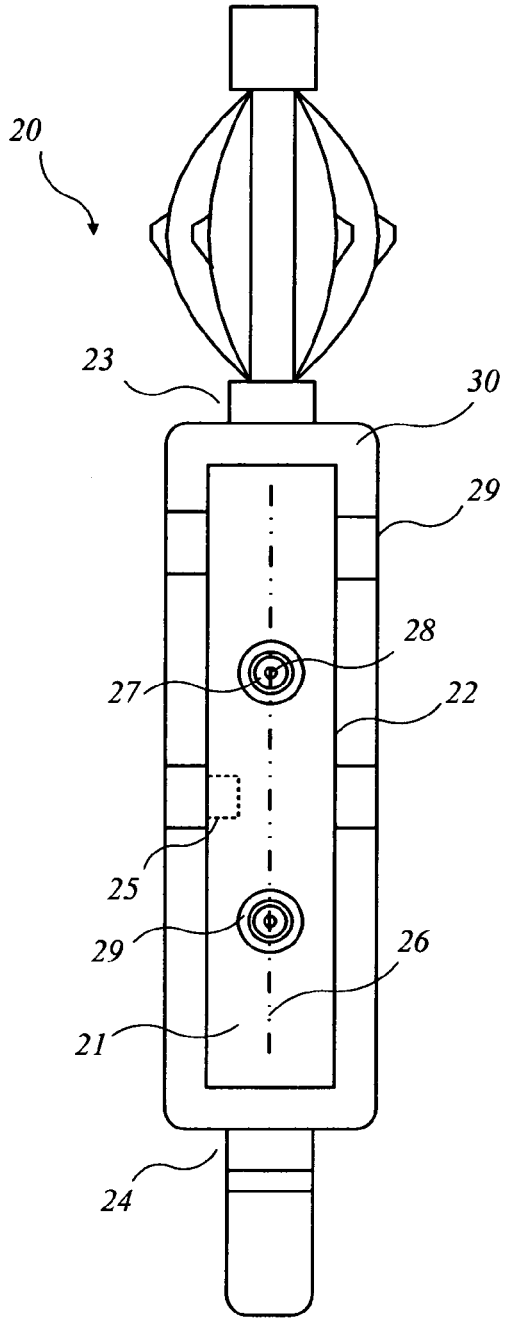
FIG. 4 shows a schematic side view of an alternative embodiment of the tool of the invention in FIG. 2 with more bow springs and alternative gauge rings.
Figure 5:
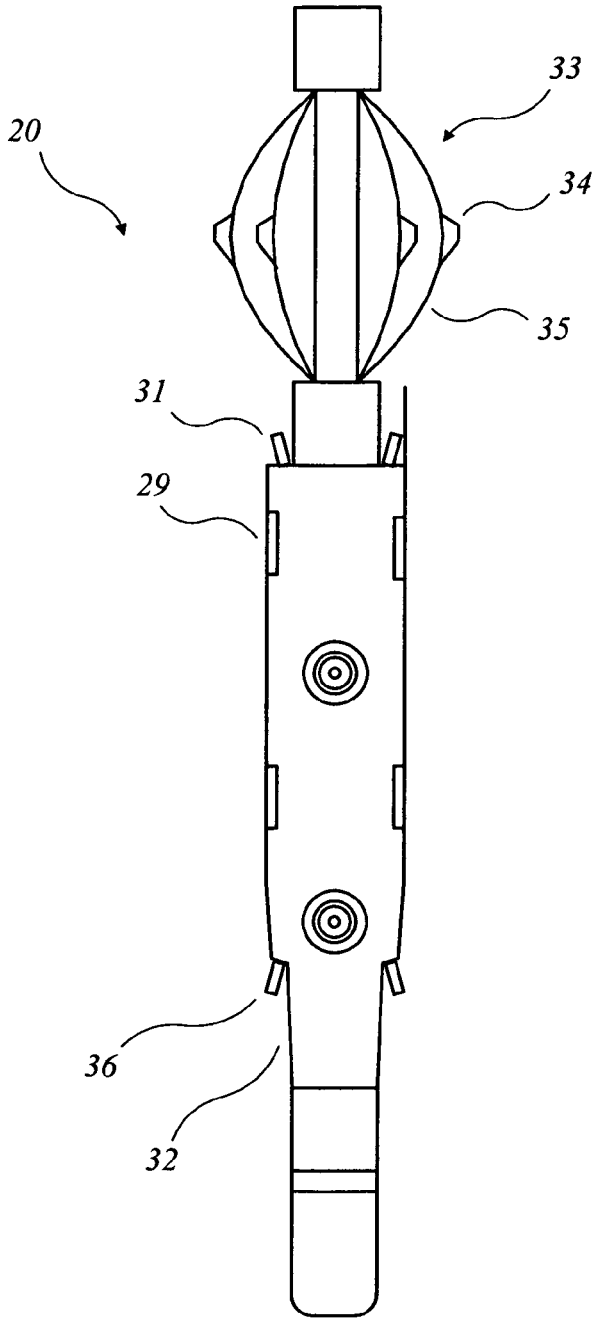
FIG. 5 shows a schematic side view of an alternative embodiment of the tool of the invention in FIG. 3 with more bow springs and an alternative taper shape.

FIG. 2 shows a schematic side view of a general embodiment of the tool of the invention. Depending on the specific application, the general embodiment may use one or more variations to this basic configuration. FIGS. 3-5 show schematic side views of alternative embodiments of the tool of the invention shown in FIG. 2.

The abrasive jet perforating tool of the invention is designated generally by reference numeral 20 in FIGS. 2-5. In FIG. 2, the main body of the tool 20 comprises a conduit, preferably in the form of a generally cylindrically shaped tube 21. Although the tool 20 is illustrated here with the preferred embodiment of a tube 21 as the body, this cylindrical shape is not necessarily a limitation of the invention. The body could have other appropriate shapes in other alternative embodiments. The tool 20 further comprises a side 22, an upper portion 23, and a lower portion 24, threaded connection fittings (not shown) on the upper portion 23 and lower portion 24 of the tube 21, and a plurality of holes 25 tapped and threaded into the side 22 of the tube 21. The threaded holes 25 are oriented in a direction that is perpendicular, or near perpendicular, to the longitudinal axis 26 of the tube 21. The threaded connection fittings on the upper portion 23 and lower portion 24 of the tube 21 are used to connect the tool 20 to other components of the well string. The tool 20 further comprises threaded abrasive jets 27 (nozzles) mounted in at least some of the threaded holes 25 on the side 22 of the tube 21. The abrasive jets 27 further comprise jetting orifices 28 that extend throughout the length of the abrasive jets 27.

In order to effectively perform sand jet perforating, a specific distance from the end of the jet orifice 28 to the casing (12 in FIG. 1) is desired. That distance is a function of the jetting orifice 28 diameter. In order to achieve that desired distance with the above referenced tool design, tools with different outer diameters (OD) are needed for different sizes of casing. With numerous casing weights (differences in wall thickness) for each casing size, a tool with a different outer diameter might even be required in the same casing size. This means that to achieve the optimum distance from jetting orifice 28 to casing, several tools would be required in inventory to be able to meet a given customer's needs. Also, a non-standard size of casing or a damaged casing might require the manufacture of a specific tool for the job. The use of the abrasive jet perforating tool 20 of the invention is designed to avoid these problems associated with the perforating jets used in conventional tools.

In an alternative embodiment, the tool 20 can have abrasive jets 27 that extend radially out from the side 22 of the tube 21 toward the casing wall (12 in FIG. 1). The tool 20 has protective plates 29, also known as blast plates, also extending radially out from the side 22 of the tube 21 and surrounding the abrasive jets 27 to protect the abrasive jets 27 from damage. The abrasive-carrying fluid slurry ejected by the abrasive jets 27 can rebound back from impingement on the casing, cement, or reservoir (12, 13, and 11, respectively, in FIG. 1) and potentially damage the abrasive jets 27. The protective plates 29 for the abrasive jets 27 are generally rectangular in cross section, as illustrated in both FIGS. 2 and 3, but can also be round in cross section, as illustrated in FIGS. 4 and 5. In general, the cross-sectional shape of the abrasive jets 27 is not limited in the invention. In addition, the protective plates 29 can vary in radial extension length.

The tool 20 has gauge rings 30 (or their equivalent, as shown in FIG. 4) that slide onto the outer diameter of the upper portion 23 and the lower portion 24 of the tube 21. The gauge rings 30, also known as sizing rings or spacing rings, are designed to not interfere with the flow from the abrasive jets 27, and are larger in outer diameter than the abrasive jets 27 mounted in the tube 21. The gauge rings 30 center the tool 20 in the casing, protect the abrasive jets 27 from wearing against the casing, and will stop the tool 20 from advancing through the casing if the inner diameter of the casing does not permit the entire tool 20 to pass through. The gauge rings 30 may be very short longitudinally compared to the length of the tool 20 (such as, for example, 1"-2"), as shown in FIG. 2, or they may cover the entire tube 21 with cut out areas for the abrasive jets 27 and protective plate 29 locations, as shown in FIG. 4.

In an alternative embodiment, different materials could be used in the making of the various apparatus described. Specifically, the gauge rings 30 could be made from a steel alloy or from another material with good abrasive wear but lower structural strength (e.g., nylon) that could be pulled apart by some type of pulling unit if the gauge ring 30 were to become lodged in the well hole. Using abrasive jets 27 of different length in conjunction with protective plates 29 and gauge rings 30 allow one basic tool 20 to be used in wells of varying sizes. This will decrease costs by requiring fewer tools in inventory to service the customer.

FIG. 3 shows a schematic side view of an alternative embodiment of the tool of the invention with a tapered lower portion. In this alternative embodiment, the tool 20 can further comprise smaller circulation jets 31 located in the upper portion 23 of the tube 21. The circulation jets 31 are oriented in a direction that is near parallel with the longitudinal axis 26 of the tube 21. The circulation jets 31 in the upper portion 23 of the tube 21 could vary in number and size, but also in the angle from parallel with the longitudinal axis 26 of the tube 21. The circulation jets 31 would most likely not be exactly vertical (i.e., parallel with the longitudinal axis 26 of the tube 21), due to concerns that the circulation jets 31 could damage the upper portion of the bottom hole assembly or the tubing string itself. Additional circulation jets (36 in FIG. 5) could also be placed in a vertical downward facing direction on the lower portion 24 of the tube 21 to prevent sand from settling on portions of the tool 20 below these lower circulation jets. The addition of the vertical circulation jets 31 prevents sand from settling on the tool 20, and helps avoid getting the tool 20 stuck in the wellbore.

In a further alternative embodiment illustrated in FIG. 3, the tool 20 may have an outer diameter 32 of the lower portion 24 of the tube 21 with a generally tapered or other non-uniform shape. The outer diameter 32 shape of the tool 20 for open hole may be a generally linear taper, the taper could curve as it reduces in size, or, as shown in FIG. 5, the taper in the tool 20 may contain small steps on which vertical circulation jets 36 could be placed facing downward. The tapered outer diameter 32 of the tool 20 in openhole conditions will allow the tool 20 to be more easily removed from the sand and cuttings that may settle below it, so that the tool 20 does not become lodged in the hole.

As illustrated in both FIGS. 2 and 3, the tool 20 further comprises a mechanical casing collar locator 33 attached to the upper portion 23 of the tube 21. The casing collar locator 33 is attached via the threaded connection fittings on the upper portion 23 of the tube 21. The casing collar locator 33 comprises an adjustable bow spring centralizer that has "buttons" 34 attached at the outermost curvature of the bow springs 35. The buttons 34 will attempt to seat in the space between two sections of casing where they are joined by a casing collar. The buttons 34 are tapered is such a way as to allow additional vertical force on the tool 20 to unseat the buttons 34 and allow the tool 20 to travel in the casing.

FIGS. 4 and 5 show schematic side view of alternative embodiments of the tool of the invention shown in FIGS. 2 and 3, respectively. FIG. 4 shows the tool with more bow springs and alternative gauge rings, while FIG. 5 shows the tool with more bow springs and an alternative taper shape. As illustrated in both FIGS. 4 and 5, the mechanical casing collar locator 33 may contain several (for example, 3 or more) bow springs 35 with buttons 34 on them. One or more buttons 34 may be used and they could either be flat on top with angled sides or rounded. The mechanical casing collar locator 33 will provide valuable information about the depth of the tool 20 so that the tool 20 can be located precisely in the reservoir. This precision is very important in placing the perforations accurately in the productive hydrocarbon containing zones of the reservoir, which can be quite thin.

Locating a perforation with respect to depth in the well bore and the reservoir is of great importance, especially with very thin (for example, 2'-3' thick) zones. Many conventional techniques use an electronic/magnetic casing collar locator to determine depth of the tool 20. Encountered casing joints are recorded and compared to the log of the well to determine the exact placement of the tool 20. While this logging method is accurate, it requires the use of electronics on board the tool 20 which both adds additional cost and could fail in the presence of high temperature or other adverse conditions. Another method for determining correct tool 20 placement depth is to set a bridge plug below the desired production zone. This generally requires a wireline logging truck to set the plug and verify depth and later requires the plug to be removed from the well bore. For tools run on jointed tubing, a gamma log could be run through the tubing and used to log the well and position the tool 20. Again, this requires the use of additional equipment and services. Mechanical casing collar locators may also be used to determine depth by engaging a slip against the casing using a spring in a pocket on the locating tool. One problem with this method is the debris, sand, and cuttings that can accumulate inside the pocket, thus restricting the movement of the slip. The use of the casing collar locator 33 of the invention with the abrasive jet perforating tool 20 is designed to avoid all these problems associated with conventional casing collar locators.

In an alternative embodiment, the buttons 35 on the mechanical casing collar locator 33 would be made from a material with excellent abrasion resistance and good impact resistance. This material includes, but is not limited to, carbide and tool steel.

To date, abrasive jet perforating technology has been offered only as a service provided by service companies for their customers. The service providers also provide equipment and personnel to complete the process. As the demand for this technology grows, these tools 20 will become rental items, much like downhole mud motors, drilling jars, or shock subs. With tool rental comes a decrease in the amount of control that the manufacturer has over the tool 20 since the tool 20 will likely be left with the customer without supervision. A new challenge of protecting intellectual property related to the unauthorized use or duplication of this property will present itself.

The jet end, or head of the abrasive jet 27, is shaped is such a way as to prevent common hand tools (such as, for example, wrenches, sockets, pliers, and screwdrivers) from being able to remove the jets 27 from the tool unless a custom removal tool is used. For example, the jet head can be a square shape inside of a circle, a circle inside a circle with two holes, or other shapes that do not fit common hand tools, such as a triangle inside a circle. A specially shaped abrasive jet 27 and protective plate 29 will prevent the unwanted removal of the abrasive jets 27 and will thus help to protect the intellectual property in the tool 20. This protection leads to cost savings for the service provider and, hence, for the customers.

Depending on the well parameters, some of the alternate features of the tool of the invention illustrated in FIGS. 3-5 may not be used with in conjunction with the other features. These well parameters would include, but not be limited to, whether the wellbore is cased or uncased, type of completion, size and weight of the casing, depth, formation type, and special conditions. A variety of different jet quantities, orifice sizes, and placement locations can be used with the improvements listed for this tool.

Figure 6:
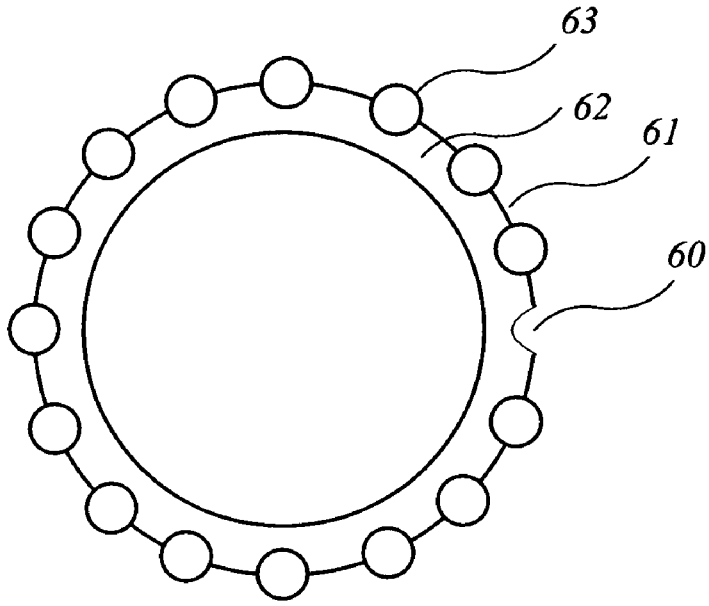
FIG. 6 shows another alternative embodiment of the tool of the invention for horizontal wells.
Figure 7:
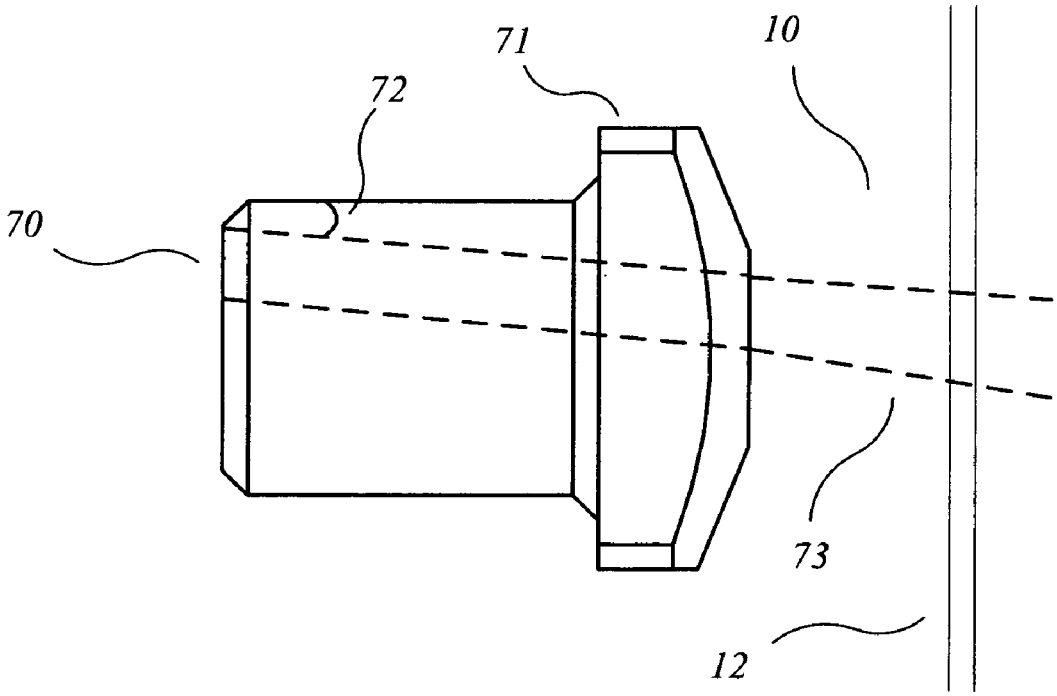
FIG. 7 shows another alternative embodiment of the tool of the invention for angled perforation.
Figure 8:
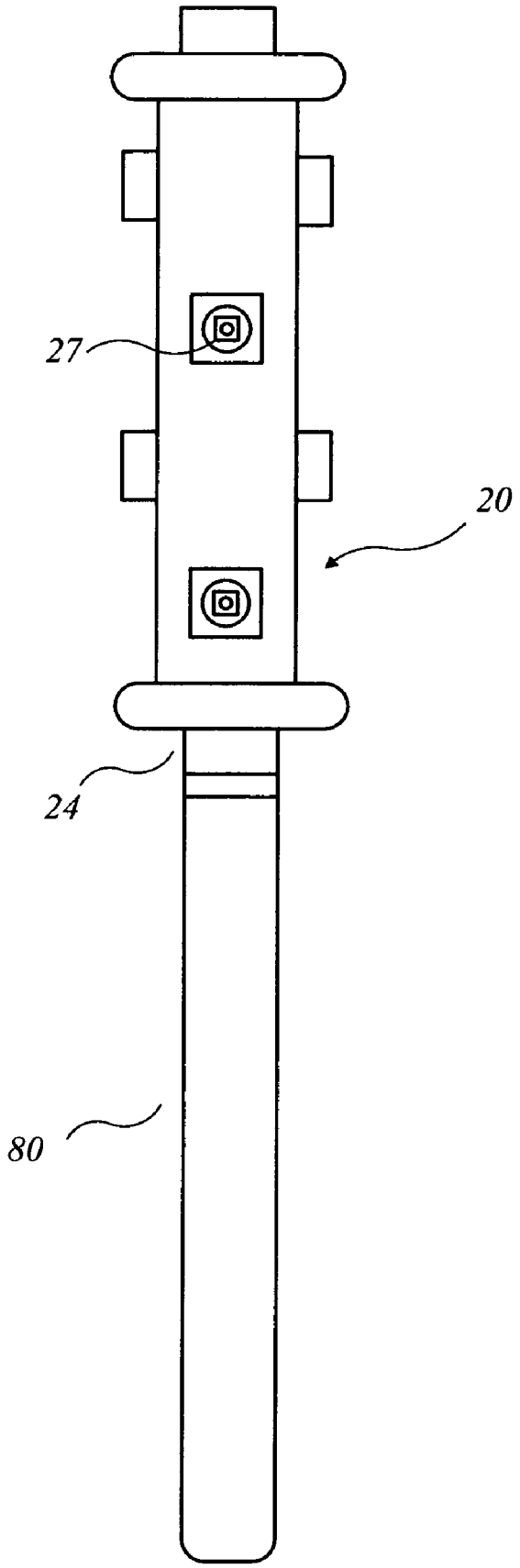
FIG. 8 shows another alternative embodiment of the tool of the invention using an abrasive reservoir.

FIGS. 6-8 are schematic side views of additional alternative embodiments of the tool of the invention shown in FIG. 2.

FIG. 6 shows another alternative embodiment of the tool of the invention for horizontal wells. In this alternative embodiment, pockets 60 are added around the outer diameter 61 of the gauge rings 62 to hold ball bearings 63. The ball bearings 63 would then reduce friction at any contact between the tool and the casing, but especially in horizontal wells when the full weight of the tool will be lying on one side of the casing (and, in particular, on the gauge rings 62). Maintaining string weight is a challenge in horizontal holes and any opportunity to reduce the drag of the string in the wellbore is very helpful.

FIG. 7 shows another alternative embodiment of the tool of the invention for angled perforation. In this alternative embodiment, a jet inset 70 in the jet body 71 of the abrasive jet (27 in FIGS. 2-5) is oriented at an angle 72 other than 90° with respect to the wellbore 10 and casing 12. This angling provides an angled abrasive fluid flow 73 through the wellbore 10 and the casing 12. The jet inserts are typically made of an abrasive-resistant metal, such as carbide. However, this is not a limitation of the invention. The jet inserts could also be constructed of other appropriate materials, such as ceramics. Conventionally, when jets are oriented at other angles, an angled hole is drilled in the tool for the entire jet to be at this angle, as exemplified in U.S. Pat. No. 5,499,678, discussed above. This alternative embodiment of the tool of the invention allows an angled hole to be perforated while still using a perpendicular abrasive jet. Hence, a unique cavity (19 in FIG. 1) can be perforated by the tool of the invention without requiring the expensive and time-consuming manufacture of a custom-made specialty tool.

FIG. 8 shows another alternative embodiment of the tool of the invention using an abrasive reservoir. In this alternative embodiment, an abrasive reservoir 80 is added in a chamber below the tool 20. The abrasive reservoir 80 is attached to the tool 20 via the threaded connection fittings on the lower portion 24 of the tool 20. It is extremely costly to pump abrasives in the high pressure fluid flow. The pumps that can withstand the abrasive and the high pressure are expensive to rent, purchase, or maintain. The abrasive reservoir 80 located below the tool would be open only to the internal cavity of the tool 20, and would be filled with the appropriate abrasive and perhaps also with abrasive mixed with polymer gel. As the non-abrasive pressurized fluid flows through the tool 20 and out the abrasive jets 27, turbulent, swirling flow is created that moves the sand from the abrasive reservoir 80 up into the inside of the tool 20. The abrasive is then pushed through the abrasive jets 27 and perforates the casing. This embodiment would be useful for general perforating, but also for perforating followed by acid injection, because the abrasive reservoir 80 would only have to carry the amount of sand necessary to perforate the casing. In addition, the acid would assist in creating the cavity (19 in FIG. 1).

Figure 9:
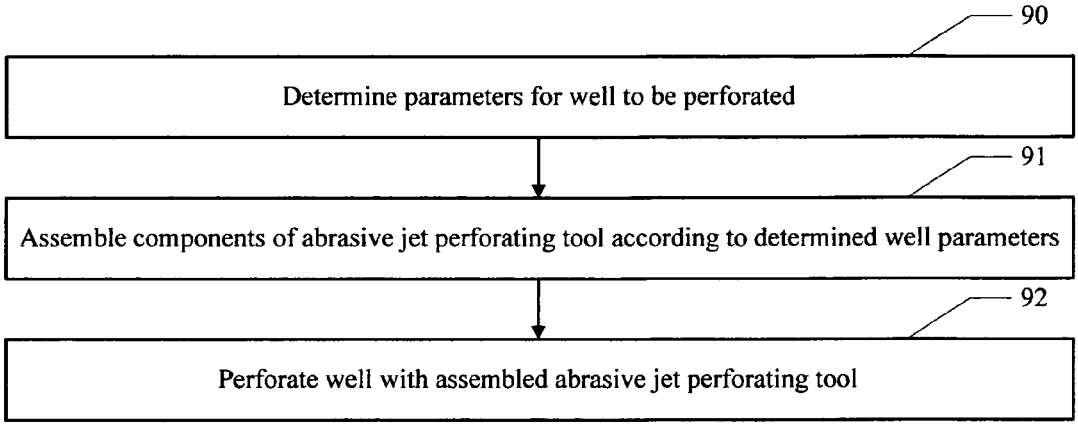
FIG. 9 shows a flowchart illustrating an embodiment of the method of the invention for performing abrasive jet perforating in a well.

In another embodiment, the invention is a method for performing abrasive jet perforating, using the abrasive jet perforating tool of the invention, described above. FIG. 9 is a flowchart illustrating an embodiment of the method of the invention for performing abrasive jet perforating.

At block 90, parameters are determined for a well to be perforated. These well parameters include, but are not limited to, the type and thickness of casing, the type and thickness of cement, the type of reservoir rock to be encountered in the zones to be perforated, and the depth of the zones to be perforated.

At block 91, the appropriate components of an abrasive jet perforating tool are assembled according to the well parameters determined in block 90. The abrasive jet perforating tool is the tool of the present invention, as described above with reference to FIGS. 2-5. The assembly of the tool can take place onsite or off-site, wherever is convenient. If the tool is assembled offsite, then the tool is shipped to the well site, where the tool assembly can be easily changed if the well parameters have changed or turn out to be different than originally expected.

At block 92, the well is perforated with the abrasive jet perforating tool assembled in block 91.

Figure 10:
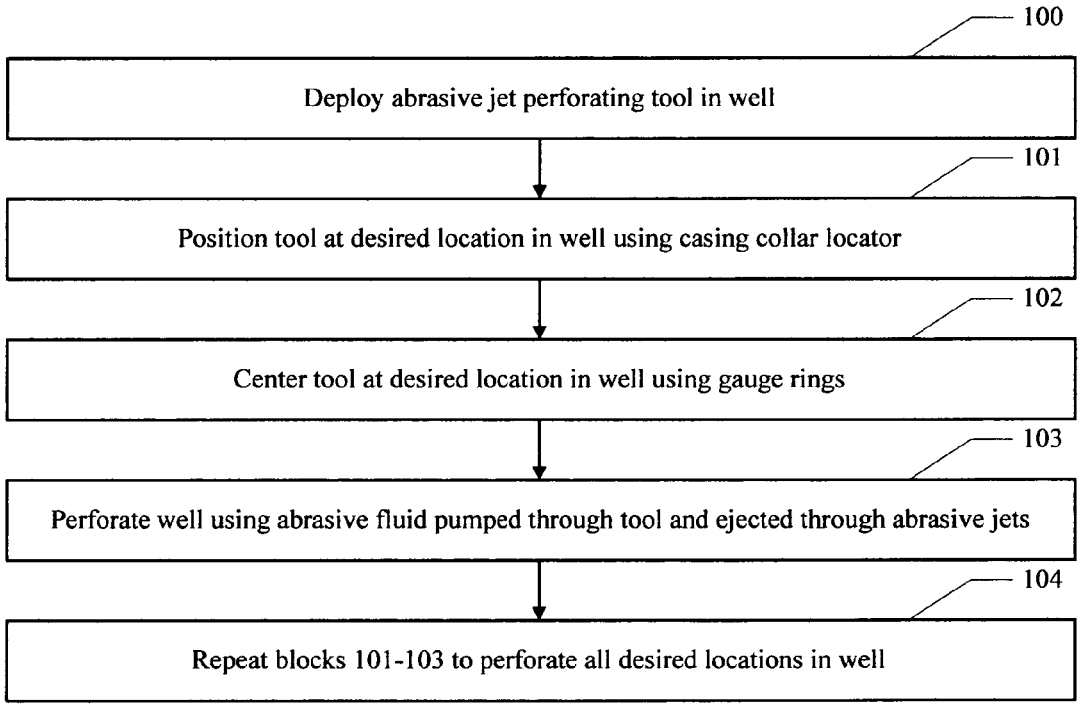
FIG. 10 is a flowchart illustrating an alternative embodiment of the method of the invention for performing abrasive jet perforating.

FIG. 10 is a flowchart illustrating an alternative embodiment of the method of the invention for performing abrasive jet perforating.

At block 100, an abrasive jet perforating tool is deployed in a well. The abrasive jet perforating tool is the tool of the present invention, as described above with reference to FIGS. 2-5.

At block 101, the abrasive jet perforating tool from block 100 is positioned at a desired location in the well using a casing collar locator.

At block 102, the abrasive jet perforating tool is centered in the well at the desired location positioned in block 101 using gauge rings.

At block 103, the well is perforated using an abrasive fluid pumped at high pressure through the abrasive jet perforating tool and ejected through the abrasive jets.

At block 104, the process in blocks 101 to 103 is repeated as desired to perforate at the next desired location.

The improved apparatus could also be used to clean out open holes that have been recently drilled and need to be irrigated. In this alternative embodiment, the tool is run within a drill string as a clean-up tool after the initial drilling of the well. A ball is then pumped to close the circulation sub, diverting fluid through the jets. The tool string is then rotated by the drilling rig as the assembly is lowered to clean out and irrigate the open hole. This clean-up version of the tool could be much larger than the tubing conveyed devices described above for perforation, but would carry the same jets. This larger size is not a limitation of the invention, though, since this clean-up version of the tool could be a similarly-sized tool as described above for perforating.

Another alternative embodiment of the invention is the use of the tool for cleaning cased holes having scale built up in casing. The scale-removal tools would be a similar size to the clean-up tools described above for open holes and would be intended to wash scale from casing inner diameter in a similar rotating and lowering method as described above.

The sand jet perforating method and apparatus described in this disclosure has numerous advantages. The addition of vertical jets prevents sand from settling on the tool, and helps avoid getting the tool stuck in the hole. The tapered outer diameter of the tool in openhole conditions will allow the tool to be removed from the sand and cuttings that may settle below it. Using jets of different length in conjunction with protective plates and sizing rings allow one universal tool to be used in wells of varying sizes. This will decrease costs by requiring fewer tools in inventory to provide service for the customers. The mechanical casing collar locator will provide valuable information about the depth of the tool so that the tool can be located precisely in the reservoir. A specially shaped jet and protective plate will prevent the unwanted removal of the jets and will help to protect intellectual property.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents.

We claim:

1. An apparatus for performing abrasive jet perforating in a well, comprising:

a generally cylindrically shaped tube with a side, an upper portion, and a lower portion;

a plurality of holes tapped and threaded into the side of the tube;

threaded abrasive jets mounted in at least some of the plurality of threaded holes;

protective plates mounted to extend radially out from the side of the tube and surround the abrasive jets to protect the abrasive jets from damage due to rebound of abrasive-carrying fluid slurry ejected by the abrasive jets;

gauge rings that slide onto an outer diameter of the upper portion and the lower portion of the tube to center the tube in the well; and a mechanical casing collar locator connected to the upper portion of the tube.

2. The apparatus of claim 1, wherein the threaded holes are oriented in a direction that is near perpendicular to a longitudinal axis of the tube.

3. The apparatus of claim 1, wherein the abrasive jets further comprise jetted orifices.

4. The apparatus of claim 3, wherein the abrasive jets further comprise:

pockets around an outer diameter of the gauge rings; and ball bearings mounted in the pockets.

5. The apparatus of claim 1, wherein the gauge rings are designed to not interfere with the flow from the abrasive jets, are larger in outer diameter than the abrasive jets mounted in the tube, and center the tool in the casing.

6. The apparatus of claim 5, wherein the gauge rings further comprise:

a jet body; and a jet inset mounted in the jet body, oriented at an angle other than 90° with respect to the longitudinal axis of the tube.

7. The apparatus of claim 1, wherein a plurality of circulation jets are located in the upper portion of the tube, with an orientation that is near perpendicular to a longitudinal axis of the tube.

8. The apparatus of claim 7, wherein a plurality of circulation jets are located in the lower portion of the tube, with an orientation that is near perpendicular to a longitudinal axis of the tube.

9. The apparatus of claim 1, wherein an outer diameter of the lower portion of the tube has a generally tapered shape.

10. The apparatus of claim 1, further comprising an abrasive reservoir attached to the lower portion of the tube.

11. A method for performing abrasive jet perforating in a well, comprising:

determining well parameters for the well;

assembling an abrasive jet perforating tool according to the well parameters, wherein the abrasive jet perforating tool comprises:

a generally cylindrically shaped tube with aside, an upper portion, and a lower portion;

a plurality of holes tapped and threaded into the side of the tube;

threaded abrasive jets mounted in at least some of the plurality of threaded holes;

protective plates mounted to extend radially out from the side of the tube and surround the abrasive jets to protect the abrasive jets from damage due to rebound of abrasive-carrying fluid slurry ejected by the abrasive jets;

gauge rings that slide onto an outer diameter of the upper portion and the lower portion of the tube to center the tube in the well; and a mechanical casing collar locator connected to the upper portion of the tube; and perforating the well with the assembled abrasive jet perforating tool.

12. The method of claim 11, further comprising:

deploying the abrasive jet perforating tool in the well;

positioning the abrasive jet perforating tool at a desired location in the well using the casing collar locator;

centering the abrasive jet perforating tool using the gauge rings; and perforating the well using an abrasive fluid pumped at high pressure through the tube and ejected through the abrasive jets.

* * * * *